United States Patent [19]

Grappendorf et al.

[11] 4,352,400

[45] Oct. 5, 1982

[54] DRILL BIT

[75] Inventors: Richard H. Grappendorf, Riverton; Gordon G. Sirrine; John S. Davis, both of Sandy, all of Utah

[73] Assignee: Christensen, Inc., Salt Lake City, Utah

[21] Appl. No.: 211,884

[22] Filed: Dec. 1, 1980

[51] Int. Cl.[3] ..... E21B 10/48; E21B 10/54; E21B 10/56

[52] U.S. Cl. ..... 175/330; 175/394; 175/404; 175/410

[58] Field of Search ..... 175/329, 330, 394, 395, 175/410, 404

[56] References Cited

U.S. PATENT DOCUMENTS

| | | | |
|---|---|---|---|
| 1,172,139 | 2/1916 | Jenkins | 175/403 |
| 1,485,444 | 3/1924 | Twogood | 76/108 P |
| 1,977,845 | 10/1934 | Emmons | 76/108 R |
| 2,109,613 | 3/1938 | Cook | 175/394 |
| 3,241,624 | 3/1966 | Rassieur | 175/257 |
| 4,091,884 | 5/1978 | Thomas | 175/410 |
| 4,098,362 | 7/1978 | Bonnice | 175/329 |
| 4,248,313 | 2/1981 | Bonca | 175/394 |

FOREIGN PATENT DOCUMENTS 900099 7/1962 United Kingdom .

OTHER PUBLICATIONS

Christensen Dgw. 20-268-033 and Photos 1-3 of Prior New and Used, Worn, Bent and Broken "STRATA-PAX" Drag Bits.

*Primary Examiner*—Stephen J. Novosad
*Assistant Examiner*—Joseph Falk
*Attorney, Agent, or Firm*—Walter Fred

[57] ABSTRACT

A drill bit (10) comprises a cast body (12) with full length wide overlapping integral spiral stabilizer lands (14) between intervening spiral grooves (16), integral short, strong, stubby spiral fingers (18) reinforced by additional web portions (12*a*) angularly spaced about a short core receiving bore (b) and the longitudinal axis of the body (21).

An inclined core ejection passage (P) extends radially outwardly from a spherical inlet end thereof connected to the core receiving bore (b) and at which an inclined hard core cutter breaker inserted within a pocket is situated. The leading sides of the fingers have support surfaces (18*a*) and shoulders (18*b*) for supporting engagement with composite abrasive compact cutters comprised of a carbide backing (30*a*) bonded to the support surfaces (18*a*) and layers of bonded polycrystalline abrasive particles at opposite cutting sides (30*b*) inclined at a negative rake angle.

The body is also provided with flushing fluid passages (24) and a central bore at its drive end adapted with means (22) to connect drive means, with a flushing fluid passage therein to drive the drill bit (10).

11 Claims, 5 Drawing Figures

DRILL BIT

TECHNICAL FIELD

The invention relates to rotary drill bits and particularly to an improved multi-finger earth formation boring bit with angularly spaced full length overlapping wide spiral stabilizing lands and intervening grooves, composite compact cutting elements fixed to reinforced strong short stubby spiral fingers and an internal hard core cutter-breaker insert at the entrance of an inclined core ejection port. Hence, the spiral bit cuts and removes material faster with less vibration and hole deviation, is stronger and less prone to bend or break and has a greater life span than similar known prior art multi-finger boring bits.

BACKGROUND ART

Heretofore multi-finger rotary drill bits have a life span limited mostly by bending and breaking of the relatively long straight narrow fingers due to abrading away of the relative small amount of initial outer surface area and resulting reduced cross sectional area thereof.

Also, the initial small amount of surface area and the narrow straight projecting fingers provided very limited bit stabilization in the hole. Thus, the insufficiently stabilized bit vibrates and moves laterally in the hole causing the bit to deviate and the hard surfaces of the cutting element to flake away as they sharply strike the hard earth formations.

Multi-finger drill bits inherently cut a central core and when hard formations are encountered the cutting or penetration rate is greatly reduced or stopped if they are unable to rapidly grind, cut or break up and eject the core material.

Many prior art drill bits depend solely on the composition and an internal inclined surface of the bit blank or body to engage and break off the core produced. Others are known to have a non-cutting wear resistant core breaker insert with an inclined surface to prevent abrading of the body.

Also known are a number of composite spiral or helically fluted drill bits tipped or provided with hard cutting inserts of harder wear resistant material than the supporting body. Various cutting inserts have been made comprising various metal carbides, borides, nitrides, oxides, cubic boron nitride, natural and synthetic diamonds and mixtures or alloys thereof.

There are commercially available both diamond and boron nitride abrasive composite compact cutting inserts made and sold by General Electric under their registered tradenames "Stratapax" and "Compax" utilized in the manufacture of various types of oil drilling bits.

The Applicants' drill bit differs from those of the prior art in that it has a machined or investment cast body including shorter, stronger helically or spirally curved fingers of greater cross sectional area backed by reinforcing webs supporting composite compact cutting inserts, wide overlapping helical or spiraly stabilizing lands extending from the fingers substantially the entire length of the bit, helical or spiral grooves between the lands for rapidly conveying and flushing cuttings upwardly from the hole and a hard core cutter-breaker insert including an inclined cutting edge to rapidly cut away and break up relatively hard core formations.

DISCLOSURE OF THE INVENTION

A multi-finger rotary drill bit comprising an investment cast body with integral angularly spaced short strong helically curved fingers supporting attached preformed (preferably diamond) abrasive, composite compact cutting inserts at the cutting end thereof.

Helical or spiral wide overlapping stabilizing lands extend from the fingers substantially the axial length of the body. There are spiral or helical grooves between the stabilizing lands for rapidly conveying the cuttings and flushing fluid pumped upwardly by the action of the spiral stabilizing lands. An inclined core ejection passage is provided between fingers and adjacent a pocket containing an attached inclined hard core cutter and breaker insert made preferably of cemented tungsten carbide.

The body also has a central bore or box adapted for attaching drive means including a fluid passage to the opposite drive end thereof and passages extending from the bore to outlets between adjacent fingers and cutters for conveying and directing flushing and/or cutting fluid to the cutters and spiral grooves.

The lower leading or forward end portion of each helical finger has a pocket including a recessed surface and adjoining shoulder machined therein and into which a preformed abrasive composite compact cutting element is inserted, fastened (preferably brazed) to and supported by the recessed surface and shoulder.

One inclined edge of the hard core cutter-breaker is positioned to rapidly cut away the relatively hard cores while the adjacent upwardly inclined surfaces of the core ejection passage subsequently engaged by the core acts to deflect and direct both the cuttings and pieces of the core out of the ejection passage.

BEST MODE OF CARRYING OUT THE INVENTION

Figure 2:
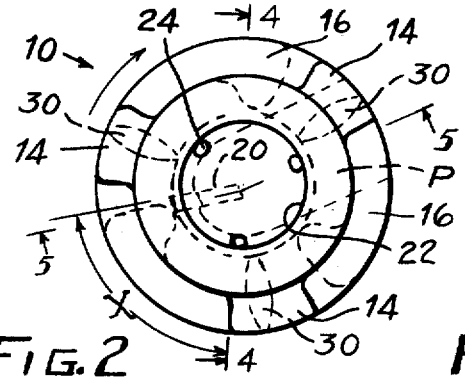
FIG. 2 is a top or drive end view of the drill bit of FIG. 1.
Figure 4:
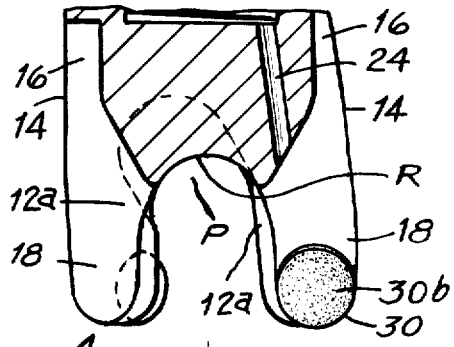
FIG. 4 is a partial cross sectional view through the lower cutting portion of the bit taken along line 4—4 of FIGS. 2 and 3.
Figure 1:
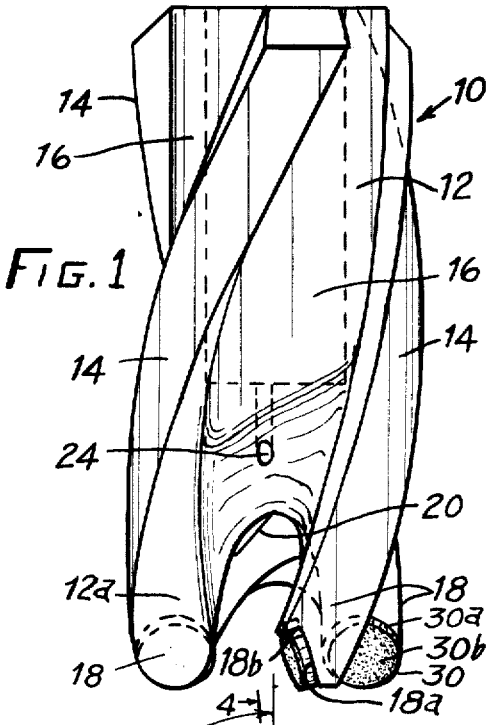
FIG. 1 is a front or side view in elevation of the spiral multi-finger cutter drill bit of the invention.
Figure 5:
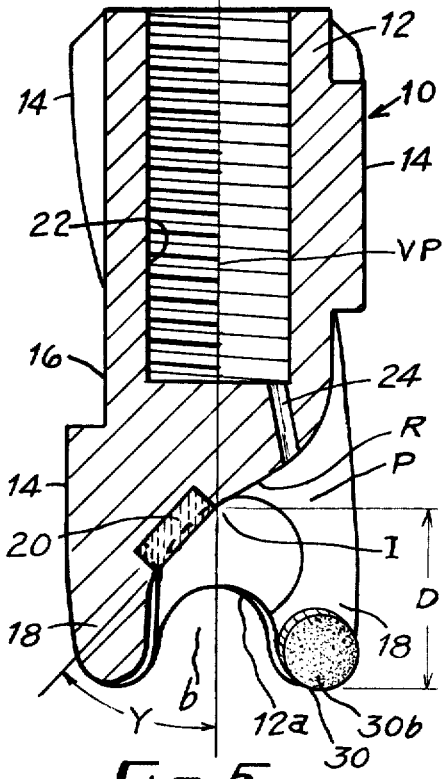
FIG. 5 is a cross-sectional view through the entire bit taken along line 5—5 of FIGS. 2 and 3.
Figure 3B:
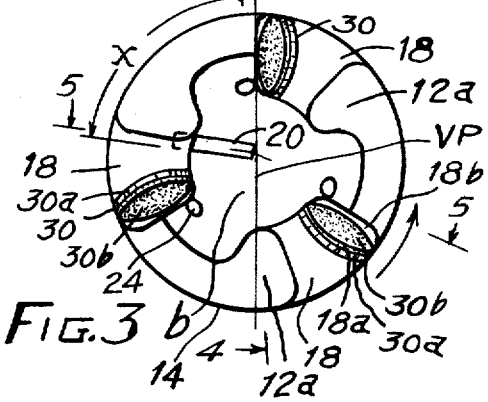
FIG. 3 is a bottom or cutting end view of the drill bit of FIG. 1.

Referring to the drawings there is shown an improved stabilized multi-finger earth boring drag type drill bit 10 for boring holes about two (2) inches (5.08 cm) in diameter.

Bit 10 comprises preferably an investment cast drill blank or body 12 about 1.875 inches (4.76 cm) in diameter with an axial length of at least 4" (10.16 cm) but preferably about 4.5 inches (11.4 cm) between its opposite cutting and drive ends and made of suitable tough metal such as 17-4 PH or 440 stainless steel.

Integral with body 12 are three wide circumferentially overlapping spiral or helical stabilizing lands 14, including spiral leading and trailing edges and side surfaces about ¼" (6.34 mm) in radial depth adjoining intervening flutes or grooves 16 of like depth and relatively short stubby and strong curved spiral fingers 18 about ⅝" (15.8 mm) long×0.504" (12.7 mm) thick in the radial direction.

As reviewed from the drive end shown in FIG. 2 the trailing spiral side surface of each spiral land extends circumferentially to a trailing end edge thereof situated at the drive end and a predetermined angular distance beyond the leading end edge of the leading spiral side surface of the adjacent spiral land at the opposite cutting end. Hence, the trailing ends of the spiral lands may overlap the leading ends of the adjacent spiral land as much as ⅓ the circumferential or angular distance between the lead ends of the adjacent lands.

The fingers 18 at the cutting end of the body extend from the lands and are angularly equally spaced about a short internal core receiving central bore b of about ⅞" (22 mm) diameter×⅝ (15.8 mm) deep and the longitudinal axis of the body.

Each of the three equally spaced overlapping spiral lands has an arcuate outer surface circumferential width of about ¾" (19 mm) and extends helically opposite the direction of rotation at a lead angle of from 60° to 70° and preferably about 66° from a plane normal to the axis and from 20° to 30° and preferably 24° from the plane of the axis for substantially the entire axial length of the body to provide a total stabilizing land surface area of of least 9 square inches (58 sq.cm). Preferably, the spiral finger portions 18 project downwardly from the bottom and forwardly of the integral finger reinforcing web portions 12*a* of the body 12. The web portion 12*a* extend both circumferential and upwardly away from the cutting ends on the back trailing sides of the spiral fingers 18.

Formed in the lower central portion of the body extending between the fingers 18 is an upwardly inclined core ejecting port or passage P. The port P extends from an inner semi-spherical curved inlet end surface thereof adjoining the inside of one spiral finger portion and radially outwardly between the other adjacent pair of fingers to an opposite side outlet or exit thereof.

The axis and upper most center portion of the internal semi circular core deflecting surface and roof R of the port P is inclined 20° to 40° but preferably about 30° from the horizontal and extends between points of tangentcy with the inner concave surface at the inlet end and the outer convex surface at the opposite outlet end of the ejection port P. The sloping roof and surfaces of the ejection port engage, laterally deflect and break up the core cut by the bit. Preferably, the ejection port P is cast but may be machined in the body with a ⅞" (22 mm) diameter spherical end mill cutter or grinding point presented and fed at an angle of about 30° from and toward a horizontal plane normal to the axis and circumferentially approximately 120° from a vertical plane VP passing through the bit axis and a point of the leading edge of an adjacent finger 18 situated thereon.

Inserted and fixed by brazing in a narrow rectangular shape pocket cast or machined into the wall of the finger adjoining the inner concave inlet end surface of the ejection port P and the core receiving bore is a hard core cutting and breaking blade or insert 20.

The core cutter breaker 20 is preferably a rectangular piece of sintered tungsten carbide about 0.141 inches (3.56 mm) thick, ¼" (6.35 mm) wide by ½" (12.7 mm) long with a straight cutting edge projecting beyond the adjacent inner concave inlet surface.

The straight core cutting edge and adjoining narrow end surface of the cutting blade 20 extends at an incline Y of 45° to 57° and preferably about 51° from point I on the vertical plane VP on the longitudinal axis to a spiral finger. Preferably, the upper point of the cutting edge is situated substantially at or near a point of intersection I with the vertical plane and the inclined plane of the upper most inclined center portion of the internal semicircular surface and roof R of the ejection port P. The narrow upper edge and lower surface adjoining the cutting edge extend radially at an inclined angle of up to 10° and preferably about 8° from the vertical plane VP through the axis. Also, the opposite edge and adjoining opposite side of the cutter 20 is angularly situated in a radial plane passing through the axis at an angle X of 74° to 90° and preferably about 82° from the vertical plane VP of the bit axis.

The vertical distance D to the upper point of cutting edge at or near the intersection I and the lower end of the finger is a critical dimension preferably equal to approximately 1½ times the diameter of the core cut or the internal diameter of the core receiving bore. Hence, in the core of the bit 10 adapted to cut a core almost ⅞" (22 mm) in diameter the vertical distance D would be about 1.3 inches (3.3 cm). The diameter of the core cut is determined by subtracting from the industry standard AX size drill bit two (2) times (x) the diameter of the cutting element 30.

Drive means, such as an EW rod box, is preferably provided for rotatably driving the drill bit 10. The drive means may comprise a plain or threaded 1" (26 mm) diameter central bore or box 22 as shown of predetermined axial depth of about 2.5" (6.35 cm) from the opposite or drive end thereof for attaching a correspondingly sized plain or threaded EW drive rod of a drill string thereto in the known manner.

Extending through a bottom portion of the body situated between and adjoining the bottom of the central bore 22 and the fingers 18 are a plurality or three equally angularly spaced fluid passages 24. The passages 24 are slightly inclined outwardly from inlets at the bottom of bore 22 toward outlets thereof for directing streams of flushing fluid outwardly between fingers, and particularly close to the leading side of each of the fingers 18 and to the cutting face of each of the cutting elements 30 attached thereto.

Hence, the flushing fluid forced through a passage in the conventional EW rods, of the drill string, the bore 22 and passages 24 will with the aid of the pumping action provided by rotation of the spiral lands 14 carry material cut away by the bit upwardly through the spiral grooves 16 between the stabilizing lands 14.

Each cutting element 30 is preferably, but not necessarily a circular composite compact disc, including diamond abrasive particles, inserted into a pocket and attached to an inclined recessed surface 18*a* machined into the lower leading supporting end portion of each spiral finger 18.

Above each pocket is an upper shoulder 18*b* including an arcuate or partly circular surface extending normal to and from the inclined recessed surface 18*a* and parallel to the central axis of the cutting element 30.

Preferably each inclined recessed surfaces 18*a* supporting a cutting element 30 and hence the leading cutting face of the cutting elements 30 situated parallel thereto is inclined rearwardly and downwardly away from the direction of rotation and the center of the adjoining arcuate surface of the shoulder 18*b* and upper central leading point of the cutting edge around the cutting element 30.

The leading cutting side or face of each element 30 is preferably situated on a radial inclined plane extending radially from the axis of the bit and inclined rearwardly toward the cutting end at a negative rake angle of up to −25° from the vertical plane of bits longitudinal axis. Hence, the rearwardly or negatively inclined lower semi-circular cutting edge about the lower half of the cutting face of each element 30 cuts away the formation, the guage of the bore hole and the core subsequently engaged and disintegrated by the core cutter breaker blade 20. Conversely, the forwardly inclined leading upper semi circular edge about the upper half face of each cutting element 30 does substantially no cutting while the shoulder and arcuate surface thereof supportingly engage a portion of the semi-circular peripheral surface about the upper half of each cutting element 30.

Depending on the hardness of the formation encountered, each element 30 may comprise a disc of bonded materials elected from a group consisting of metal oxides, carbides, borides, nitrides, cemented tungsten carbide, cubic boron nitride, diamond, mixtures and composites thereof.

Preferably, each of the cutting elements 30 is a composite compact disc comprising a hard backing layer or disc **30*a* to which a layer of hard cutting abrasive particles 30*b*** are bonded to provide the cutting edge and face thereof.

The backing or supporting disc or layer **30*a* may be made of cemented or metal bonded titanium, zirconium or tungsten carbide, silicon carbide, boron carbide, mixtures thereof and any other material to which the cutting particles 30*b* can be tenaciously bonded and likewise bonded to the recess surfaces 18*a* of the fingers 18**.

There are a variety of composite cutting elements commercially available from various sources suitable for attachment to the fingers 18 of the body 12.

Such suitable composite compact cutting elements or discs disclosed in U.S. Pat. Nos. 4,098,362; 4,156,329; 4,186,628; and 4,225,322; manufactured as taught in U.S. Pat. Nos. 3,743,489, 3,745,623, and 3,767,371 are made and sold by General Electric under the registered tradenames "Stratapax" and "Compax". Another is made and sold by DeBeers Diamond Tool under their registered tradename "Syndite".

Basically "Stratapax" and "Compax" are preformed composite compact cutters each comprising a thin planar layer or disc consisting of a mass of self bonded polycrystalline abrasive particles such as synthetic or natural diamond and hexagonal or cubic boron nitride directly bonded to a layer or disc of metal bonded or cemented metal carbide coated with a layer of brazing or silver solder filler metal for attachment to the recess surfaces **18*a* of the fingers 18**.

However, the bit 10 is preferably provided with "Stratapax" synthetic diamond composite compact cutting elements 30 each about 0.524 inches (13.2 mm) in diameter X 0.130 inches (3.3 mm) thick comprising a layer of −400 U.S. Standard mesh diameter particles about 0.020" (0.5 mm) and a cemented tungsten carbide layer about 0.110" (2.79 mm) thick. The composite cutting elements 30 are mounted and brazed to the recessed surfaces **18*a* of each finger so the diamond cutting side or face of layer 30*b* thereof has negative a rake angle of about −20° relative to the direction of rotation and a vertical plane extending through and from the axis. Hence, during rotation of the bit the material of formation cut by the lower half of the cutting edge of the element 30 is directed upwardly along the negatively inclined diamond abrasive face thereof toward the direction of bit rotation and an adjacent spiral groove 16**.

When the lower semi-circular cutting half of the cutter disc 30 become dull or worn they may be removed and reattached to the same or another body in the same manner with the unworn cutting edge rotated 180° to the cutting end of the fingers and drill bit.

In use the drive end of the drill bit is attached to a first rod section of a drill string attached to and rotatably driven by a conventional drilling machine, such as a Track or Tricycle machine.

During drilling the machine transmits both axial and rotational forces by way of the drill rod to the body 12, the surfaces **18*a* and shoulders 18*b* of the fingers to the cutting element 30. Hence, during cutting the elements 30 are placed in compression diametrically between the supporting shoulders 18*b* and the formation engaging the opposite peripheral surfaces thereof and compressed axially between the engaging formation and the supporting surfaces 18*b*** rotated toward the formation.

As the bit rotates the lower half of each inclined element 30 cuts into the formation and causes the cuttings to move forwardly and upwardly along the leading incline cutting faces and into adjacent spiral grooves and streams of flushing fluid passing therethrough.

Likewise, the inclined hard core cutter-breaker 20 is also placed in compression between the supporting bit body 12 and the core formation during axial and rotational displacement of the drill bit. Thus, the cutting elements 30 and core cutter-breaker 20 which are normally weaker when placed in tension are, during cutting, placed in their stronger compressive state and adequately supported by the short strong and stubby spiral fingers 12 reinforced by the additional supporting web portions **12*a*** against failure under exceptionally heavy loads of axial and rotational stress.

The core of the hard or soft formation is rapidly cut away and/or broken up by the inclined core cutter-breaker 20, deflected and directed by the incline roof R of the ejection port toward and out the outlet thereof into a stream of flushing fluid and the adjacent spiral groove.

As the flushing fluid under pressure emerges it carries the cuttings upwardly through the spiral grooves of the rotating drill bit and out of the bore hole. Rotation of the helical lands and adjoining leading edges and side surfaces which spiral at a lead angle of about 66° from a plane normal to the axis and about 24° from the plane of the axis away from the direction of bit rotation act to pump and accelerate the movement of the recirculating flushing fluid and the cuttings suspended therein out the bore hole.

The desired depth of the bore hole is attained by attaching additional rod sections of the drill string together in the known conventional manner.

Drill bits constructed in accordance with the invention and to the size and specification disclosed above have been tested.

The testing was conducted under actual field conditions by making a number of borings at a dam site with the equipment and results indicated in following Tables I and II.

TABLE I

DRILLING TWO HOLES AT SAME LOCATION WITH SAME BIT, EQUIPMENT AND CONDITIONS

1st Hole

Bit A: New 3 spiral finger bit of the invention
Location: ⅜ up right abutment of dam site in moderately hard greenstone.
Equipment:
80–100 PSI (5.62–7.03 kg/sq.cm) $H_2O$, Gravity only
200–400 pounds (90.7–181.4 kg) down pressure 0–500 RPM - Majority of time at higher RPM
Track Machine 10' (3.048 m) Rod Cap

DRILLING RESULTS:

| | |
|---|---|
| 1st 10' (3.048 m) Rod | 3 Minutes |
| 2 10' (3.048 m) Rod | 7 Minutes |
| 3 10' (3.048 m) Rod | 2 Minutes |
| 4 10' (3.048 m) Rod | 10 Minutes |
| 5 10' (3.048 m) Rod | 5 Minutes |
| 6 10' (3.048 m) Rod | 8 Minutes |
| 7 10' (3.048 m) Rod | 5 Minutes |
| 70'–0 (21.335 m) TD | 40 Minutes |

AVERAGE RESULTS: 1.75' (.533 m)/Minute = 105' (32 m)/Hour

2nd Hole

Bit A: Same as 1st Hole
Location: Hole next to 1st hole, similar formation
Equipment: Same as 1st hole

DRILLING RESULTS:

| | |
|---|---|
| 1st 10' (3.048 m) Rod | 2 Minutes |
| 2 10' (3.048 m) Rod | 3 Minutes |
| 3 10' (3.048 m) Rod | 2 Minutes |
| 4 10' (3.048 m) Rod | 4 Minutes |
| 5 10' (3.048 m) Rod | 7 Minutes |
| 6 10' (3.048 m) Rod | 11 Minutes |
| 7 10' (3.048 m) Rod | 5 Minutes |
| 70'–0 (21.335 m) TD | 34 Minutes |

AVERAGE RESULTS: 2.1' (.64 m)/Minute = 123.6' (39.672 m)/Hour

TOTAL DEPTH ON BIT A: 140' (42.67 m)/1 hour 14 minutes

AVERAGE RATES: 1. 1.89' (.576 m)/minute
2. 113.5' (34.593 m)/hour

TABLE II

DRILLING ADDITIONAL HOLES WITH DIFFERENT EQUIPMENT

3rd Hole

Bit B: New three spiral finger bit of the invention
Location: Top left abutment of dam site
Equipment:
200 PSI (14.kg/sq.cm) & Pump Assisted $H_2O$
200–400 Pounds (90.7–181.4 kg) down pressure
0–500 RPM majority of time at higher RPM
Tricycle machine with winch and 5' (1.524m) Rod Cap

DRILLING RESULTS:

| | |
|---|---|
| 1st 5' (1.524M) Rod | 45 Seconds |
| 2 5' (1.524M) Rod | 30 Seconds |
| 3 5' (1.524M) Rod | 30 Seconds |
| 4 5' (1.524M) Rod | 15 Seconds |
| 5 5' (1.524M) Rod | 35 Seconds |
| 6 5' (1.524M) Rod | 45 Seconds |
| 7 5' (1.524M) Rod | 45 Seconds |
| 8 5' (1.524M) Rod | 35 Seconds |
| 9 5' (1.524M) Rod | 40 Seconds |
| 10 5' (1.524M) Rod | 45 Seconds |
| 11 5' (1.524M) Rod | 40 Seconds |
| 12 5' (1.524M) Rod | 35 Seconds |
| 13 5' (1.524M) Rod | 40 Seconds |
| 14 5' (1.524M) Rod | 20 Seconds |
| 15 5' (1.524M) Rod | 50 Seconds |
| 16 5' (1.524M) Rod | 1 Minute 20 Seconds |
| 17 5' (1.524M) Rod | 1 Minute 35 Seconds |
| 18 5' (1.524M) Rod | 1 Minute 30 Seconds |
| 19 5' (1.524M) Rod | 1 Minute 20 Seconds |
| 20 5' (1.524M) Rod | 1 Minute 15 Seconds |
| 21 5' (1.524M) Rod | 2 Minute 30 Seconds |
| 22 5' (1.524M) Rod | 2 Minute 0 Seconds |
| 23 5' (1.524M) Rod | 1 Minute 45 Seconds |
| 24 5' (1.524M) Rod | 1 Minute 30 Seconds |
| 25 5' (1.524M) Rod | 1 Minute 30 Seconds |
| 26 5' (1.524M) Rod | 35 Seconds |
| 27 5' (1.524M) Rod | 35 Seconds |
| 28 5' (1.524M) Rod | 35 Seconds |
| 140' (42.67m) TD | 27 Minutes 10 Seconds |

RESULTS: 5.2' (1.585m)/Minute 309' (94.18m)/Hour

4th Hole

No times recorded for 140' (42.67m) completed. Drillers reported similar results as 3rd hole.

5th Hole

140' (42.67m) total depth almost but not reached before it was necessary to leave. However, it was estimated that the same bit B would be able to drill five (5) more holes for a total of 1120 feet (341.365 m) before resetting the "Stratapax" cutters from the worn out body onto a new blank or body 12.

Table I shows that bit A of the invention averaged 113.5 feet (34.593 m)/hour drilling two holes for a total depth (TD) of 140' (42.67 m) in one (1) hour and 14 minutes under 200–400 lbs. (90.7–181.4 kg) down pressure, at 500 RPM with a Track Machine and 10' rod cap.

We see from Table II that another new full length spiral, stabilizer Bit B of the invention driven by a Tricycle machine with winch and 5' rod cap and greater pump assisted fluid pressure averaged 309' (94.18 m)/hr or nearly 3 times faster than Bit A.

It was also estimated that the Bit B would be able to drill a total of 1120 (341.365 m) feet before the same "Stratapax" cutters needed to be removed from the worn body, rotated 180° and attached to the fingers of a new body 12 to place the initial unused upper half of the cutting edges in the cutting position.

Hence, the drilling results shows that the new full length spiral fingers drill Bits A and B constructed in accordance with the invention disclosed hereinabove did not break or wear readily and would definitely out perform and outlast similar known prior art straight finger bits with short stabilizer portions.

As many modifications of the invention are possible, it is to be understood that the embodiment disclosed hereinabove is merely an example thereof and that the invention includes all modifications, embodiments and equivalents thereof falling within the scope of the appended claims.

We claim:

1. A rotary drill bit comprising:

a body of predetermined axial length and maximum diameter with opposite cutting and drive ends rotatable about a central longitudinal axis thereof including:

a plurality of relatively strong short stubby spiral finger like portions with leading and trailing sides thereon angularly spaced about the central longitudinal axis and an internal core receiving bore of relatively short axial depth adjacent the cutting end of the body and the finger like portions, a plurality of reinforcing web portions extending circumferentially and away from the cutting ends on trailing sides of the spiral finger like portions, a plurality of angularly spaced overlapping outer spiral stabilizer lands including leading and trailing spiral side edges and surfaces extending exteriorly and helically opposite to direction of bit rotation substantially the axial length of the body between the opposite cutting and drive ends thereof, a plurality of angularly spaced spiral grooves extending between the spiral lands and connected to the short internal core receiving bore, an inclined core ejection passage including an inclined internal surface extending radially outwardly and inclined toward the opposite drive end of the body from a closed inlet end adjoining an inner surface portion of a spiral finger portion and the central core receiving bore to an opposite outlet end connected with a spiral groove and situated between a pair of adjacent spiral finger like portions, and connecting means adjacent the drive end of the body adapted for attaching means to rotatably drive the drill bit, preformed cutting elements attached to support surfaces on the leading sides of the spiral finger portions and each having a back side adjacent a support surface and a cutting side including a cutting edge opposite the back side, and a preformed hard core cutter element fixed within a pocket provided at the closed inlet end of the core ejection port and having an inclined cutting edge diverging from a point thereof situated adjacent an intersection of the inclined internal surface of the core ejection passage and plane of the longitudinal axis of the body.

2. A rotary multi finger drill bit according to claim 1 wherein each of the spiral finger like portions further comprises:

a shoulder portion and surface situated adjacent to and extending from the support surface for supporting engagement with the cutting element.

3. A rotary drill bit according to claim 1 wherein the plurality of spiral lands comprises:

three angularly spaced overlapping spiral lands each extending helically at a lead angle of from 60° to 70° about the body and of sufficient length and width to provide a total stabilizing outer spiral surface area of at least 9 sq.in (58 sq.cm) on the body.

4. A rotary drill bit according to claim 1 wherein the inclined internal surface of the core ejection passage is inclined radially outwardly toward the drive end of the body at an angle of about 20° to 40° relative to a plane normal to the longitudinal axis.

5. A rotary drill bit according to claim 1 wherein the core receiving bore and core ejection passage are of substantially the same radius and diameter and connected by an internal spherical surface at the closed inlet end of the ejection passage.

6. A rotary drill bit according to claim 1 wherein the core cutter element is preformed of a cemented carbide body with the inclined cutting edge thereof diverging away from the point and the intersecting plane of the longitudinal axis at an angle of about 45° to 57°.

7. A rotary drill bit according to claim 1 wherein the point of the inclined cutting edge at the intersection is situated a distance approximately 1½ times the diameter of the internal core receiving bore from the cutting end of the drill bit.

8. A rotary drill bit according to claim 1 wherein each of the preformed cutting elements comprises:

a cemented carbide backing member including a front side and a back side adapted for and attached to a support surface; and a layer of bonded polycrystalline abrasive particles bonded to the front side of the carbide backing member and providing the cutting element with at least a semi-circular abrasive cutting side and cutting edge.

9. A rotary drill bit according to claim 1 wherein the cutting side and cutting edge of each preformed cutting element is situated on an inclined radial plane and inclined at a negative rake angle of up to −25° relative to and away from the plane of the longitudinal axis and toward the trailing side to a further point of the cutting edge at the cutting end of the adjacent spiral finger like portion of the body.

10. A rotary drill bit according to claim 1 further comprising:

a central bore extending a predetermined axial depth from the opposite drive end of the body to a bottom thereof, and a plurality of angularly spaced fluid passages extending from inlets at the bottom of the central bore to outlets situated adjacent to and adapted to direct fluid toward the cutting end of the spiral finger portions.

11. A rotary drill bit according to claim 10 wherein the connecting means further comprises:

screw threads about the central bore adapted to mate with screw threads of means adapted for conveying fluid and driving the drill bit.

* * * * *